US006945753B2

(12) United States Patent
Chiang et al.

(10) Patent No.: US 6,945,753 B2
(45) Date of Patent: Sep. 20, 2005

(54) SMOKE EXHAUSTER HAVING IMPROVED FAN DEVICE

(76) Inventors: Chao Cheng Chiang, P.O. Box 63-99, Taichung (TW), 406; Chi Shyong Chiang, P.O. Box 63-99, Taichung (TW), 406

( * ) Notice: Subject to any disclaimer, the term of this patent is extended or adjusted under 35 U.S.C. 154(b) by 140 days.

(21) Appl. No.: 10/638,153

(22) Filed: Aug. 6, 2003

(65) Prior Publication Data

US 2005/0028808 A1 Feb. 10, 2005

(51) Int. Cl.[7] ..... F04D 29/30

(52) U.S. Cl. ..... 416/178; 416/186 R; 416/187; 416/214 R

(58) Field of Search ..... 416/214 R, 228, 416/243, 223 R, 223 B, 178, 186 R, 187

(56) References Cited

U.S. PATENT DOCUMENTS 1,730,372 A * 10/1929 Laurie ..... 416/187
1,876,518 A * 9/1932 Mathis ..... 416/221
2,803,398 A * 8/1957 Sprouse ..... 416/187
4,418,261 A * 11/1983 Jailor et al. ..... 219/757
5,035,398 A * 7/1991 Chiang ..... 248/674
5,979,436 A 11/1999 Chiang et al. ..... 126/299 D
5,988,979 A * 11/1999 Wang ..... 416/178
6,782,885 B1 * 8/2004 Chiang et al. ..... 126/299 R
2003/0101985 A1 * 6/2003 Chiang et al. ..... 126/299 R

* cited by examiner

*Primary Examiner*—Edward K. Look
*Assistant Examiner*—Igor Kershteyn
(74) *Attorney, Agent, or Firm*—Charles E. Baxley

(57) ABSTRACT

A smoke exhauster includes a motor attached to a housing, and a fan device attached to the motor and to be driven by the motor. The fan device including an upper plate, a lower plate having a bore, and a number of fan blades secured between the upper and the lower plates to form a chamber between the upper and the lower plates and to allow air to flow into the chamber of the fan device via the bore of the lower plate. Each of the fan blades includes a lower cut-off portion to allow the air to flow deeper into the chamber of the fan device before contacting with or scooped by the fan blades.

7 Claims, 6 Drawing Sheets

SMOKE EXHAUSTER HAVING IMPROVED FAN DEVICE

The present invention relates to the U.S. patent application Ser. No. 10/000,307, filed 4 Dec. 2001, pending.

BACKGROUND OF THE INVENTION

1. Field of the Invention

The present invention relates to a smoke exhauster, and more particularly to a smoke exhauster having an improved fan device for increasing the air drawing effect thereof.

2. Description of the Prior Art

The applicants have developed various kinds of typical smoke exhausters which comprise one or more centrifugal fan devices each having a fan casing and a number of radially extended fan blades directly punched or forged or extended from the fan casing.

For example, U.S. Pat. No. 5,979,436 to Chiang et al. discloses one of the typical smoke exhausters. Due to the directly punching or forming of the fan blades from the fan casing, the fan blades may only be formed with a single curvature and may include a limited or a small area for actuating the air.

The present invention has arisen to mitigate and/or obviate the afore-described disadvantages of the conventional smoke exhausters.

SUMMARY OF THE INVENTION

The primary objective of the present invention is to provide a smoke exhauster including an improved fan device for increasing the air drawing effect to the fan device.

In accordance with one aspect of the invention, there is provided a smoke exhauster comprising a housing, a motor attached to the housing, and a fan device attached to the motor and to be driven by the motor. The fan device includes an upper plate, a lower plate which has a bore formed therein, and a plurality of fan blades secured between the upper plate and the lower plate, to define a chamber between the upper plate and the lower plate of the fan device. The chamber of the fan device is communicating with the bore of the lower plate to allow air to flow into the chamber of the fan device, and each of the fan blades includes a lower cut-off portion formed therein to allow the air to flow deeper into the chamber of the fan device before contacting with the fan blades.

The upper plate and the lower plate each includes a plurality of slits formed therein, each of the fan blades includes an upper portion and a lower portion each having at least one ear extended therefrom and engaged through the slits of the upper and the lower plates, for securing the fan blades between the upper and the lower plates.

Each of the fan blades includes an inclined edge defined by the lower cut-off portion thereof, and includes an inner segment, an intermediate segment, and an outer segment, the outer segment of the fan blade includes a width no greater than that of the lower plate of the fan device.

The inner segment of the fan blade includes a height smaller than that of the intermediate segment and the outer segment of the fan blade. The outer segment of the fan blade includes a width smaller than that of the inner segment and the intermediate segment of the fan blade. The intermediate segment of the fan blade includes a curvature greater than that of the inner segment of the fan blade. The intermediate segment of the fan blade includes a curvature less than that of the outer segment of the fan blade.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
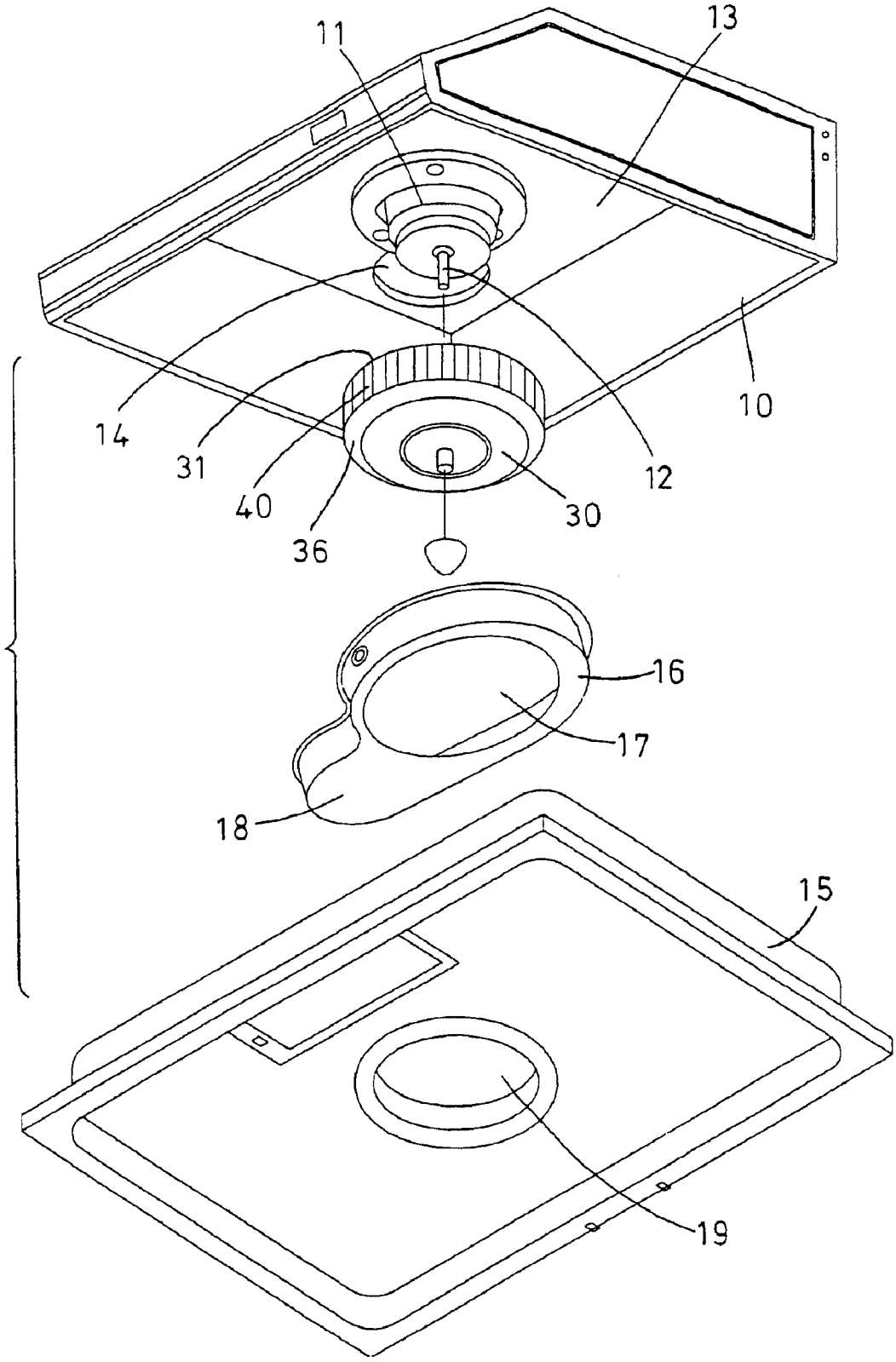
FIG. 1 is a partial exploded view of a smoke exhauster in accordance with the present invention.

Referring to the drawings, and initially to FIG. 1, a smoke exhauster in accordance with the present invention comprises a housing 10, a motor 11 secured to the ceiling or the top panel 13 of the housing 10, and a fan device 30 attached or secured to the spindle 12 of the motor 11 for being actuated or driven by the motor 11. The top panel 13 of the housing 10 includes an orifice 14 formed therein for air circulation purposes.

A casing 16 is engaged onto the fan device 30 and secured to the top panel 13 of the housing 10, for covering or shielding the peripheral portion of the fan device 30, and includes an opening 17 formed therein and aligned with the fan device 30, for allowing air to be drawn into the casing 16 by the fan device 30. The casing 16 includes a conduit 18 formed or provided therein and directed toward the orifice 14 of the housing 10 for directing the air out through the orifice 14 of the housing 10.

A board 15 is attached or secured to the bottom of the housing 10 for covering or shielding the housing 10, and includes an aperture 19 formed therein and aligned with the opening 17 of the casing 16 and the fan device 30, for allowing the air to be drawn through the aperture 19 of the board 15 and to be drawn into the casing 16 by the fan device 30.

Figure 3:
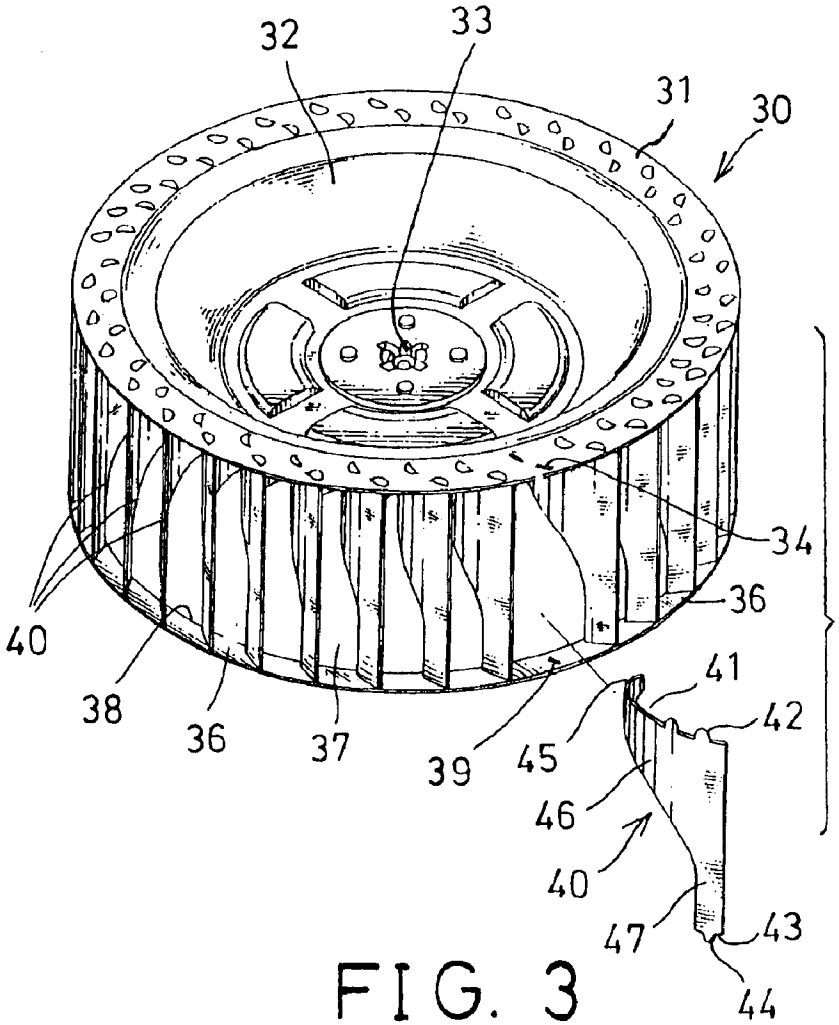
FIG. 3 is a partial exploded view of the fan device of the smoke exhauster.
Figure 2:
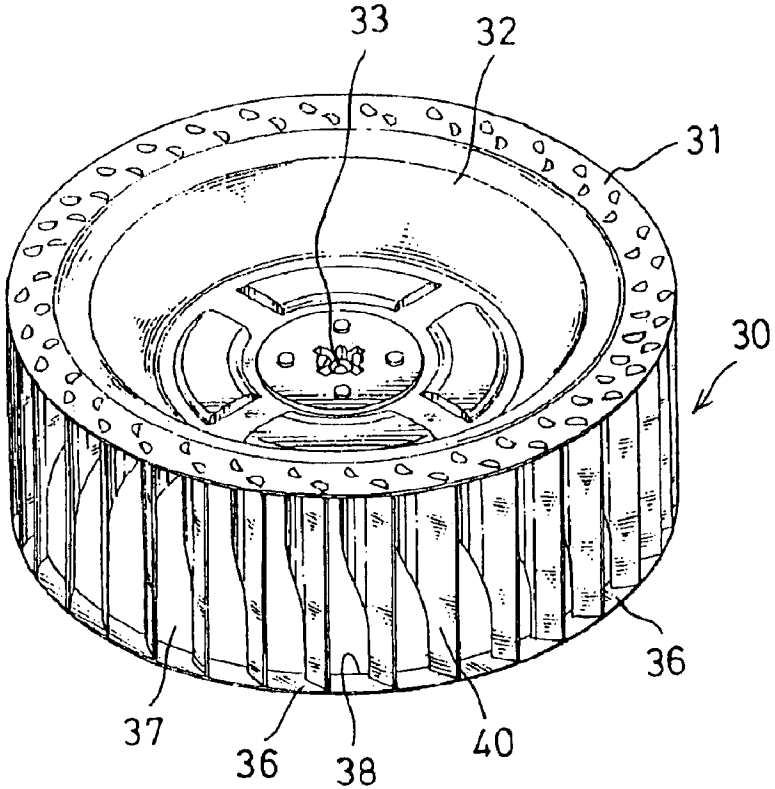
FIG. 2 is a perspective view of the fan device of the smoke exhauster.
Figure 4:
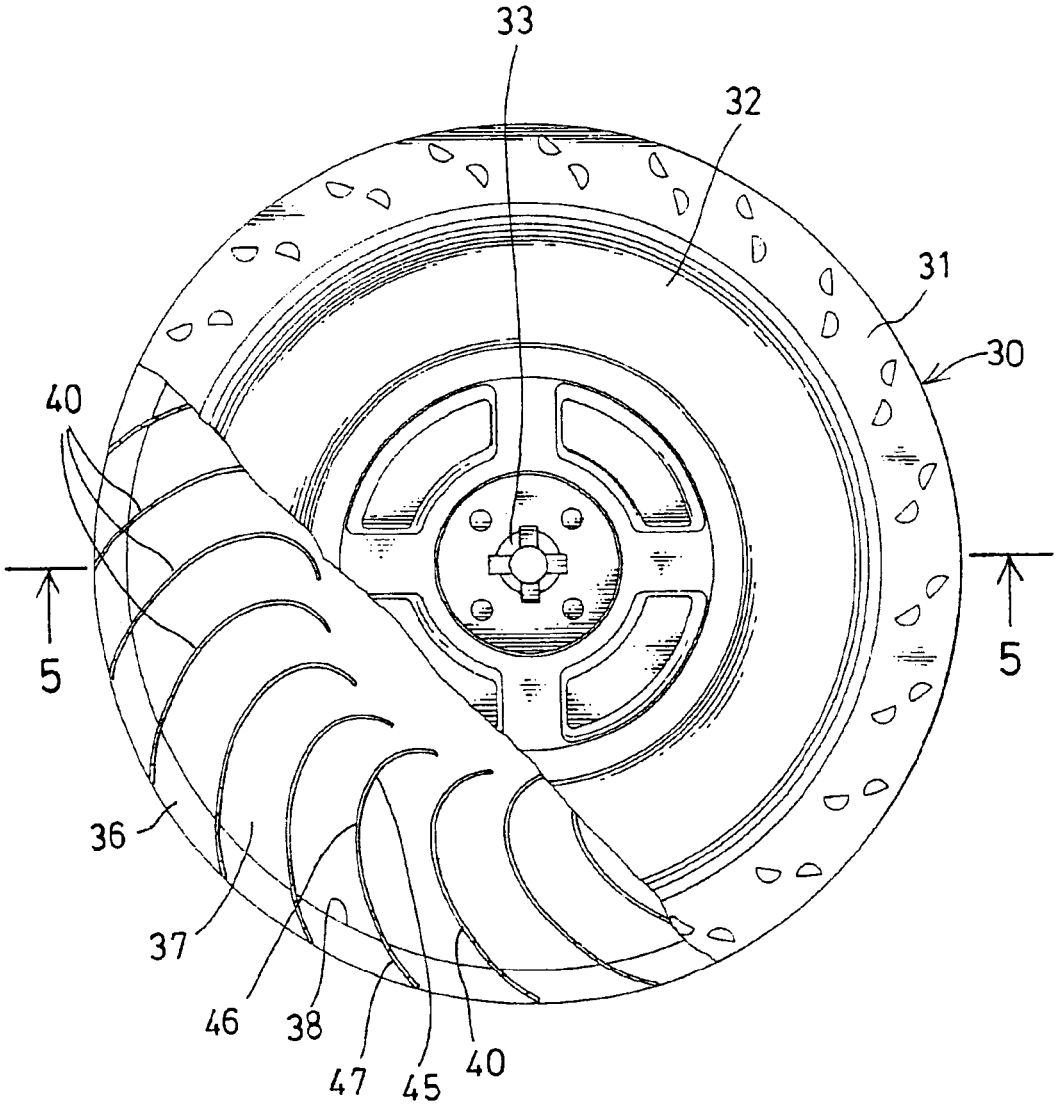
FIG. 4 is a top plan view of the fan device, in which a portion of the upper plate of the fan device has been cut off for showing the inner structure of the fan device.

Referring next to FIGS. 2–6, the fan device 30 includes an upper plate 31 having a recess or depression 32 formed in the upper portion thereof for receiving the lower portion of the motor 11, and having a hub 33 attached thereto for receiving or for securing to the spindle 12 of the motor 11. The upper plate 31 includes an outer peripheral portion having a number of slits 34 formed therein, particularly having a number pairs of slits 34 formed therein (FIG. 3).

A lower plate 36 is disposed below the upper plate 31 and to be secured to the upper plate 31 with a number of fan blades 40, and for forming a chamber 37 between the upper and the lower plates 31, 36. The lower plate 36 includes a bore 38 formed therein and communicating with the chamber 37 of the fan device 30, for allowing air to be drawn into the chamber 37 of the fan device 30. The lower plate 36 includes a number of slits 39 or a number pairs of slits 39 formed therein (FIG. 3).

Each of the fan blades 40 includes an upper portion 41 having one or more ears 42 extended upwardly therefrom and engaged through the slits 34 of the upper plate 31, and bent or secured to the upper plate 31, for securing the fan blades 40 to the upper plate 31. Each of the fan blades 40 includes a lower portion 43 having one or more ears 44 extended downwardly therefrom and engaged through the slits 39 of the lower plate 36, and bent or secured to the lower plate 36, for securing the fan blades 40 to the lower plate 36. The fan blades 40 may thus be solidly secured between the outer peripheral portions of the upper plate 31 and the lower plate 36.

As shown in FIGS. 3–7, each of the fan blades 40 includes a first or an inner segment 45 and a second or an intermediate segment 46 extended inwardly relative to the bore 38 of the lower plate 36, for scooping the air in the chamber 37 of the fan device 30, and includes a third or an outer segment 47 disposed or secured between the outer peripheral portions of the upper plate 31 and the lower plate 36.

Figure 7:
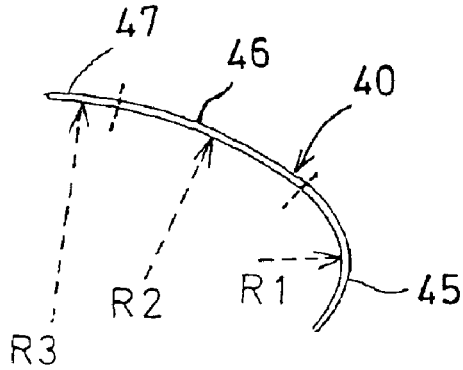
FIG. 7 is a top plan view of the fan blade of the fan device.

As best shown in FIG. 7, the inner segment 45 of the fan blade 40 includes a curvature or a semi-diameter R1 preferably less than the curvature or the semi-diameter R2 of the intermediate segment 46 of the fan blade 40. The semi-diameter R2 of the intermediate segment 46 of the fan blade 40 is preferably less than the curvature or the semi-diameter R3 of the outer segment 47 of the fan blade 40.

Figure 6:
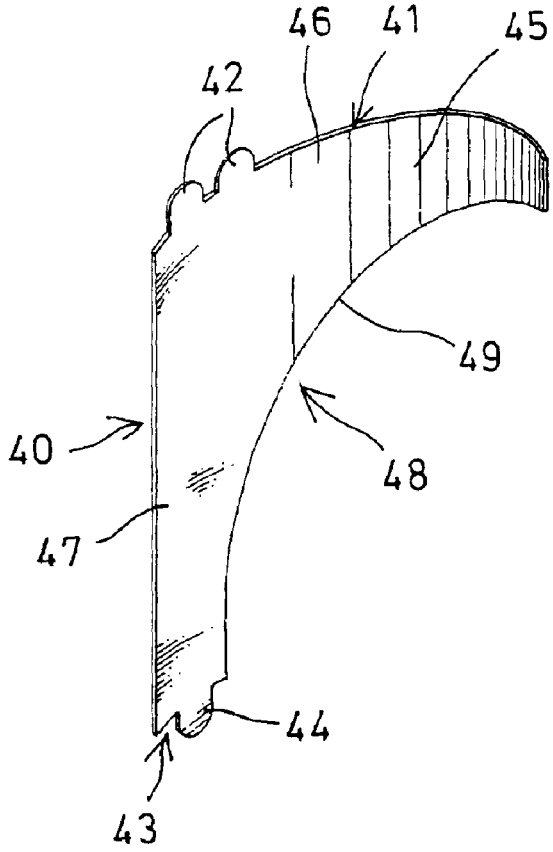
FIG. 6 is a perspective view showing one of the fan blades of the fan device.

As best shown in FIG. 6, the fan blade 40 includes a cut-off portion 48 formed or provided in the inner and lower portion thereof and defined by an inclined or curved and inclined edge 49, such that the inner segment 45 of the fan blade 40 includes a height smaller than that of the intermediate segment 46 and the outer segment 47 of the fan blade 40, and such that the outer segment 47 of the fan blade 40 includes a width smaller than that of the inner segment 45 and the intermediate segment 46 of the fan blade 40. It is preferable that the outer segment 47 of the fan blade 40 includes a width equals to or smaller than that of the lower plate 36 of the fan device 30.

Figure 5:
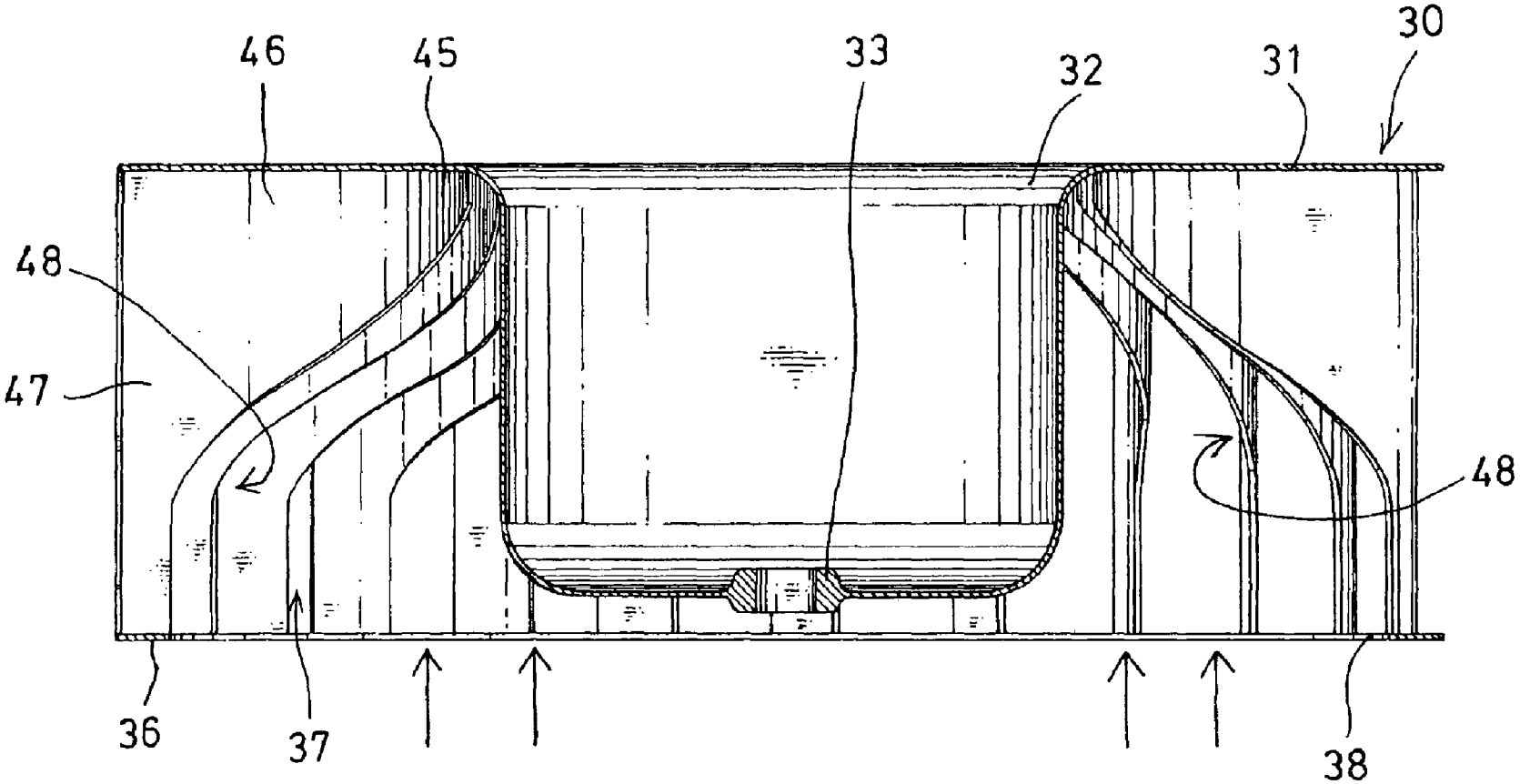
FIG. 5 is a cross sectional view taken along lines 5—5 of FIG. 4.
Figure 8:
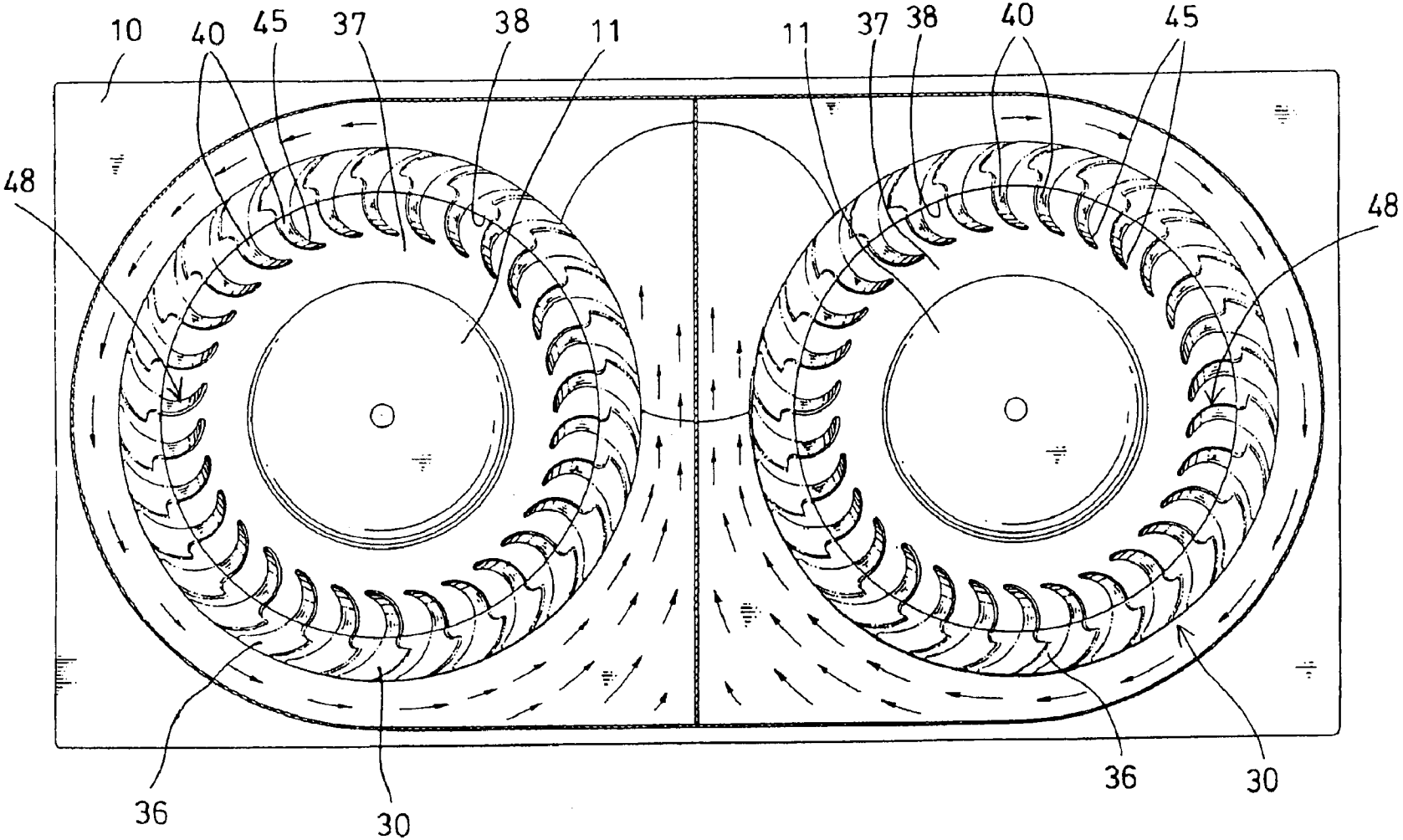
FIG. 8 is a bottom plan view illustrating the operation of the fan device of the smoke exhauster.

In operation, as shown in FIGS. 5 and 8, due to the formation or provision of the cut-off portions 48 in the fan blades 40, the fan device 30 thus includes a widely opened lower portion formed and defined by the bore 38 of the lower plate 36 and the chamber 37 of the fan device 30, for allowing the air to flow through the bore 38 of the lower plate 36 and deeper into the chamber 37 of the fan device 30, before the air may be contacted and scooped by the fan blades 40.

The smoke exhauster is shown and illustrated in FIGS. 1 and 5 of the drawing figures to include a single fan device 30 attached to the housing 10 and driven by one motor 11. However, the smoke exhauster may also include two (FIG. 8) or more fan devices 30 attached to the housing 10 and each driven by one motor 11.

It is to be noted that the fan blades 40 are shown in the drawing figures to be secured between and to be perpendicular to the upper plate 31 and the lower plate 36. However, the fan blades 40 may also be arranged or disposed to be tilted or inclined relative to the upper plate 31 and the lower plate 36.

Accordingly, the smoke exhauster in accordance with the present invention includes an improved fan device for increasing the air drawing effect to the fan device.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. A smoke exhauster comprising:

a housing, a motor attached to said housing, and a fan device attached to said motor and to be driven by said motor, said fan device including:

an upper plate, a lower plate having a bore formed therein, and a plurality of fan blades secured between said upper plate and said lower plate, to define a chamber between said upper plate and said lower plate of said fan device, said chamber of said fan device being communicating with said bore of said lower plate to allow air to flow into said chamber of said fan device, and each of said fan blades including a lower cut-off portion formed therein to allow the air to flow deeper into said chamber of said fan device before contacting with said fan blades, and each of said fan blades including an inner segment, an intermediate segment, and an outer segment, said outer segment of said fan blade including a width no greater than that of said lower plate of said fan device.

2. The smoke exhauster as claimed in claim 1, wherein said upper plate and said lower plate each includes a plurality of slits formed therein, each of said fan blades includes an upper portion and a lower portion each having at least one ear extended therefrom and engaged through said slits of said upper and said lower plates, for securing said fan blades between said upper and said lower plates.

3. The smoke exhauster as claimed in claim 1, wherein each of said fan blades includes an inclined edge defined by said lower cut-off portion thereof.

4. The smoke exhauster as claimed in claim 1, wherein said inner segment of said fan blade includes a height smaller than that of said intermediate segment and said outer segment of said fan blade.

5. The smoke exhauster as claimed in claim 1, wherein said outer segment of said fan blade includes a width smaller than that of said inner segment and said intermediate segment of said fan blade.

6. The smoke exhauster as claimed in claim 1, wherein said intermediate segment of said fan blade includes a curvature greater than that of said inner segment of said fan blade.

7. The smoke exhauster as claimed in claim 1, wherein said intermediate segment of said fan blade includes a curvature less than that of said outer segment of said fan blade.

* * * * *